US007891224B2

(12) United States Patent
Cooper et al.

(10) Patent No.: US 7,891,224 B2
(45) Date of Patent: Feb. 22, 2011

(54) MULTIPLE PIECE ROLL

(75) Inventors: Brian Cooper, Sheffield (GB); Shaun Tyas, Barnsley (GB)

(73) Assignee: Siemens Vai Metals Technologies Ltd. (GB)

( * ) Notice: Subject to any disclaimer, the term of this patent is extended or adjusted under 35 U.S.C. 154(b) by 206 days.

(21) Appl. No.: 12/089,070

(22) PCT Filed: Oct. 5, 2006

(86) PCT No.: PCT/EP2006/009630

§ 371 (c)(1),
(2), (4) Date: Apr. 3, 2008

(87) PCT Pub. No.: WO2007/045358

PCT Pub. Date: Apr. 26, 2007

(65) Prior Publication Data

US 2008/0269032 A1 Oct. 30, 2008

(30) Foreign Application Priority Data

Oct. 21, 2005 (EP) ..... 05256558

(51) Int. Cl.
*B21B 13/02* (2006.01)
*B21B 27/02* (2006.01)
*C22C 38/00* (2006.01)

(52) U.S. Cl. ..... 72/243.6; 72/241.2; 29/895.22; 492/38; 492/40; 492/47

(58) Field of Classification Search ..... 72/241.2, 72/243.6, 252.5; 492/1, 2, 38, 40, 47; 29/895.22, 29/895.2, 895
See application file for complete search history.

(56) References Cited

U.S. PATENT DOCUMENTS 3,997,953 A * 12/1976 Christ et al. ..... 492/2
4,407,151 A 10/1983 Gronbech
4,416,137 A * 11/1983 Marshall ..... 72/241.2

FOREIGN PATENT DOCUMENTS

| | | | |
|---|---|---|---|
| DE | 936 083 | | 12/1955 |
| DE | 36 42 512 | A1 | 7/1988 |
| GB | 2099343 | A * | 12/1982 |
| JP | 59-107708 | | 6/1984 |
| JP | 08-158018 | | 6/1996 |
| SU | 142269 | | 2/1961 |

OTHER PUBLICATIONS

International Search Report mailed Dec. 21, 2006 in corresponding PCT International Application No. PCT/EP2006/009630.
Office Action for Russian Application No. 2008120011/02(023479) mailed on May 25, 2010.

* cited by examiner

*Primary Examiner*—David B Jones
(74) *Attorney, Agent, or Firm*—Ostrolenk Faber LLP

(57) ABSTRACT

The invention relates to the design of multiple piece rolls, in particular backup rolls, for the use in metal rolling. The roll comprises a main part with a center bore for the removal of center defects or flaws arising from the manufacturing process, e.g., from casing or forging and at least an end part, whereas the end part has no center bore or a center bore with a diameter smaller than the bore diameter of the main part.

20 Claims, 4 Drawing Sheets

MULTIPLE PIECE ROLL

CROSS REFERENCE TO RELATED APPLICATION

The present application is a 35 U.S.C. §§371 national phase conversion of PCT/EP2006/009630, filed 5 Oct. 2006, which claims priority of European Application No. 05256558.7, filed 5 Oct. 2006. The PCT International Application was published in the English language.

BACKGROUND OF THE INVENTION

The invention relates to the design and a process for the manufacture of multiple piece rolls, in particular backup rolls, for the use in metal rolling e.g. rolling of steel or aluminium. Typically, in known systems, backup rolls are used to support the work rolls in a rolling mill. It is desirable to keep the work roll diameter small because this keeps the rolling loads and torques as low as possible. However, a small diameter work roll bends easily under the rolling load. The larger diameter backup roll is used to support the work roll and minimise the bending of the rolls under load. A 4-high mill stand comprises 2 work rolls and 2 backup rolls but the same principle also applies to other mill configurations such as 6-high mills.

In most modern rolling mills, the backup roll is manufactured as a single piece either by forging or by casting. For large rolling mills such as plate mills, the backup roll can be more than 2 meters in diameter, over 10 meters long and weigh 150 tonnes or more.

In the case of a cast roll, a double-pour casting technique is normally used in which the barrel is made from a different material to the necks and core of the roll. Spin casting techniques are often used to try to obtain homogenous properties. With very large rolls it is quite difficult to avoid porosity in the casting along the centreline of the roll due to shrinkage during cooling. Due to the large size and the difficulty in avoiding defects and flaws there are very few companies who can manufacture cast backup rolls for large plate mills.

In the case of a forged roll, the normal forging process for a roll starts with an ingot diameter which is typically 2 or more times greater than the final diameter of the roll. A large reduction in the diameter during forging is required to ensure that the material does not have any flaws or defects particularly in the centre of the roll. In order to forge the roll with a large forging reduction ratio an ingot which is much larger than the final roll size is required. In addition, the ingot is usually pressed axially in a process called upsetting in order to increase its diameter further. In order to achieve a large forging reduction the ingot size and weight are very large and consequently there are very few companies who can manufacture these large rolls.

Due to the difficulty in manufacturing large backup rolls, there is considerable interest in being able to manufacture these rolls as multiple smaller pieces instead of as a single piece.

In the past, some backup rolls have been manufactured as two pieces consisting of a sleeve or shell and an inner core. Various methods have been used for attaching the shell or sleeve to the core of the roll including shrink fitting, tapers, reversed-tapers and keys. However, these designs have not been generally accepted by the industry. One of the fundamental problems is that it is very difficult to ensure that the sleeve and the core do not slide relative to one another when the roll is loaded. When the roll is loaded it bends and the sleeve or shell tends to slide relative to the core or to separate from the core. Since the direction of the deflection of the roll changes every revolution this leads to rapid wear and damage. In addition, any sliding or separation between the sleeve and the core results in the roll exhibiting a non-linear stiffness. This causes major problems for the thickness control systems used on most rolling mills.

SUMMARY OF THE INVENTION

It is an object of the present invention to present a new roll design which allows a large backup roll to be manufactured in multiple pieces based on smaller parts and to avoid flaws or defects in the centre of the roll. This allows suppliers with limited casting and forging capacities to manufacture a large backup roll that would not be possible by existing methods.

The inventive multiple piece rolls, with a main part having a center bore for the removal of center defects or flaws arising from the manufacturing process, e.g. from casting or forging of steel and at least one end part e.g. made of steel, whereas the end part has no center bore or a center bore with a diameter smaller than the bore diameter of the main part, can be manufactured in smaller parts.

The normal forging process for a roll starts with an ingot diameter which is typically 2 or more times greater than the final diameter of the roll. However, based on the invention a much smaller forging reduction on the diameter can be used. Due to the smaller required forging reduction on the diameter it is possible that some flaws or defects remain in the structure along the centerline of the roll. Ultra-sonic inspection can be used to detect these defects. The roll can be bored along the centerline to remove the remaining defects. Calculations show that holes up to 300 mm diameter or even more down the center of the main part have very little effect on its overall stiffness or strength.

Due to one or two separated end parts it is possible to design the end parts independent of the main part. Therefore whether a bore diameter is foreseen and how the diameter is chosen can be defined independently. This allows an improved design as the bore diameter can be designed in accordance with the application and even with the internal defects or flaws.

According to an embodiment of the present invention the parts are joined by means of a form-fit joint, wherein the joint is arranged substantially at a right angle to the axis of the roll. This arrangement allows a reproducible and stiff joining of the parts. Due to the areas of contact, which are substantially at a right angle to the axis of the roll an advantageous force situation is generated in an axial direction.

According to a special embodiment of the present invention at least one part comprises a bore with a diameter varying in axial direction. The parts can be designed in accordance to the expected rolling loads. Due to the loads a different geometry of the bore can be chosen, allowing a bore, which has a diameter varying in axial direction. The diameter may be defined described by a function being symmetrical relative to the vertical plane of symmetry of the roll. However non-symmetric functions may be chosen as well.

According to a preferred embodiment of the present invention the joints are arranged outside the support area for the bearings. This design allows a joint which is only loaded by thrust and torque loads. The rolling load and the main bearing loads are all taken by the main part. The decision whether to apply a roll bore and the diameter of the roll bore can be chosen in accordance with the metallurgical requirements of existing flaws in the core part and with the load situation. This embodiment allows a big contact area for the joint.

Other positions of the joints are possible and can be chosen in accordance with the specific requirements of the roll.

According to another preferred embodiment of the present invention the joints are arranged immediately outside the roll barrel, wherein the roll barrel is formed by the main part. The joints are placed immediately outside the roll barrel of the main part. This allows machining the big diameter roll barrel of the main part independent from the end parts, which are of considerably smaller diameter. Therefore the bore diameter can be maximized for each part allowing a big bore diameter at the main part. The removal of all center flaws or defects arising from manufacturing by casting can be assured.

According to a beneficial embodiment of the present invention the joint comprises a locating spigot, a key and a number of bolts for the creation of a form-fit joint. The joint has to assure a very rigid and stiff coupling of the parts with each other. Any non-linear stiffness effects have to be avoided as these would cause major problems for the thickness control systems used on most rolling mills. The spigot is a round extension of the end piece with a smaller diameter. It fits into a hole in the end of the main part of the roll. The spigot has an interference fit into the hole to make sure that the end cannot move relative to the main part of the roll. The key prevents rotation of the end piece relative to the main part. The same principles could be used for a two piece roll with only one end attached separately or for a roll made up of more than three pieces.

According to a possible embodiment of the present invention at least one of the roll parts is made of cast and/or forged material. In the case of cast material the casting weight can be reduced compared to normal manufacturing because defects along the centerline can be removed by boring. These smaller casts can be handled by a bigger number of foundries and not only by specialised foundries. For forged material the ingot weight can be reduced and the necessary forging reduction is much less than would normally be required because defects and flaws along the centerline and in the core area of up to 150 mm or more from the centerline can be accepted as they will be removed by boring. In normal manufacturing these defects or flaws could act as sources for cracks to propagate through the roll and therefore the forging reduction has to be much larger in order to ensure that there are no significant flaws or defects in the center of the roll. The size of the bore can be selected during the manufacturing process according to the size and position of the defects that are detected.

The invention comprises also a rolling mill stand with work rolls and at least a pair of the inventive multiple piece rolls with features as set out above. The pair of multiple piece rolls is arranged as backup rolls for the support of the work rolls and to prevent excessive roll bending. Due to the backup rolls being built of different roll parts especially bigger rolls and therefore stiffer rolling mill stands can be achieved. When the rolls are loaded during rolling the bending of the set of rolls has to be kept low to allow a rolled material being produced with the desired cross section (profile). By using the inventive mill stand with the multiple piece backup rolls, bigger backup rolls can be used. The overall performance of the mill stand can be improved which means less profile defects even when rolling at high rolling loads. The multiple piece rolls allow furthermore that only specific parts of the roll are changed for maintenance reducing the maintenance costs.

Furthermore the invention comprises a process for the manufacture of rolls in metal rolling, in particular backup rolls. The rolls comprise at least one main part and at least one end part, which can be axially joined in order to form the roll. At least one of the parts is manufactured by casting and/or forging. In order to allow the removal of center defects or flaws arising from the manufacturing process an axial center bore is arranged in at least one part and the diameter of the central bore is defined based on the expected loads and the allowable stresses occurring during normal use of the roll. It is a well known process to design a roll according to the expected loads and the installation. The maximum bearable loads are limited e.g. by the material of the rolls and by local stress peaks, which should of course be kept below the fatigue strength. Defects in the material can cause local stress peaks resulting in local damage, which can grow and can lead to considerable damage e.g. fracture of the whole roll. Therefore the removal of such defects or flaws even when the material is removed and the resulting cross section is reduced can improve the lifetime of the roll as local cracks cannot start at such defects. The flaws or defects can create a starting point for a defect growing under loads. Therefore it is a big advantage when the defects, which often occur in the center region of a roll, can be removed. Due to the different diameters of the roll barrel and the roll necks the bore diameters have to be different at these parts. This is possible due to the multiple piece roll allowing different bore diameters at the different parts.

According to a special embodiment of the inventive process the bore diameter of the main part is 0.5-1.5, preferably 0.8-1, times bigger than the smallest outside diameter of the end part. These relations proved to be advantageous for various applications in metal rolling. Especially the large diameter of the center bore, which is even in the order of the smallest external diameter of an end part, e.g. the roll neck, allows the removal of all defects or flaws in the roll center. On the other hand it is possible to utilize e.g. smaller pieces during casting and forging as the required reduction for a sufficient microstructure and therefore good mechanical properties can be reduced. As the center defects can be removed the required mechanical reduction to overcome the defects can be smaller. A basic reduction is required to set the mechanical properties of the roll.

According to a preferred embodiment of the inventive process the bore diameter of each roll part is defined individually in order to allow an optimized load situation for each roll part. One piece rolls with a center bore are known from prior art. However the bore diameter has to be defined according to the smallest diameter of the roll. Therefore with single piece rolls the benefits according to the invention can not be used. The size of the bore can be selected during the manufacturing process according to the size and position of the defects that are detected and the rolling forces the roll is designed for. The separated parts allow an adjustment of the bore diameter individually for each part. Therefore machining is less complex and the diameter is chosen for each part dependent on the local load situation.

The invention is described in more detail in the following figures presenting possible embodiments of the present invention without limiting the invention to the presented embodiments.

DESCRIPTION OF PREFERRED EMBODIMENTS

Figure 1:
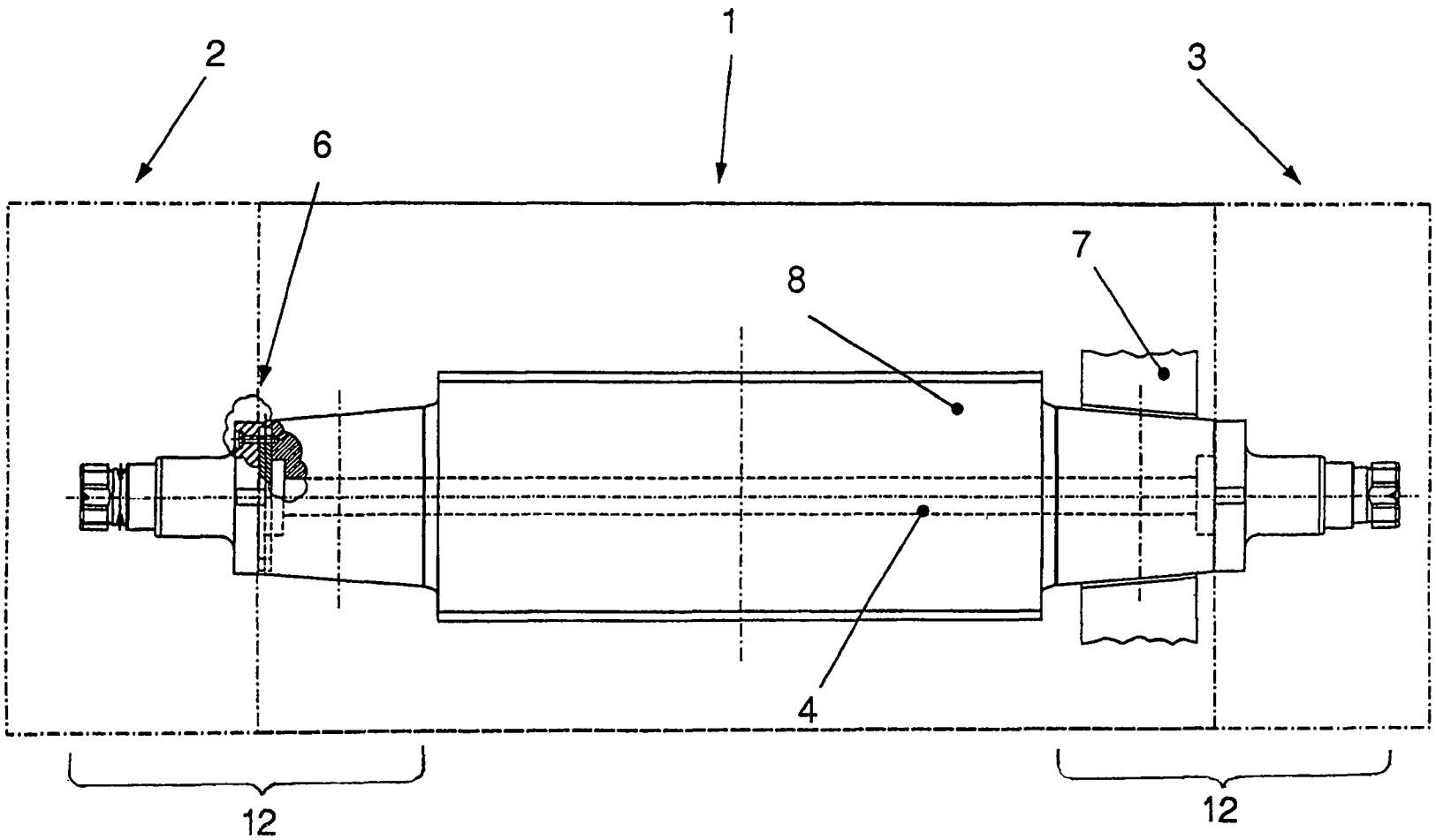
FIG. 1: The inventive roll in an embodiment with three roll parts

FIG. 1 shows a roll according to the invention with three roll parts 1, 2 and 3. The joints 6 are arranged outside of the support area for the bearings 7. The centerline at the roll neck 12 shows the centerline of the bearing 7, which is arranged in a roll chock. The main part 1 comprises the roll barrel 8 and parts of the roll necks 12. The end parts 2 and 3 are fixed by means of the joints 6 to the main part 1. The main part comprises a center bore 4, which can be manufactured as a bore with a constant bore diameter or the diameter can be adjusted dependent on the axial position. The joint is described in FIG. 3 in more detail.

Figure 2:
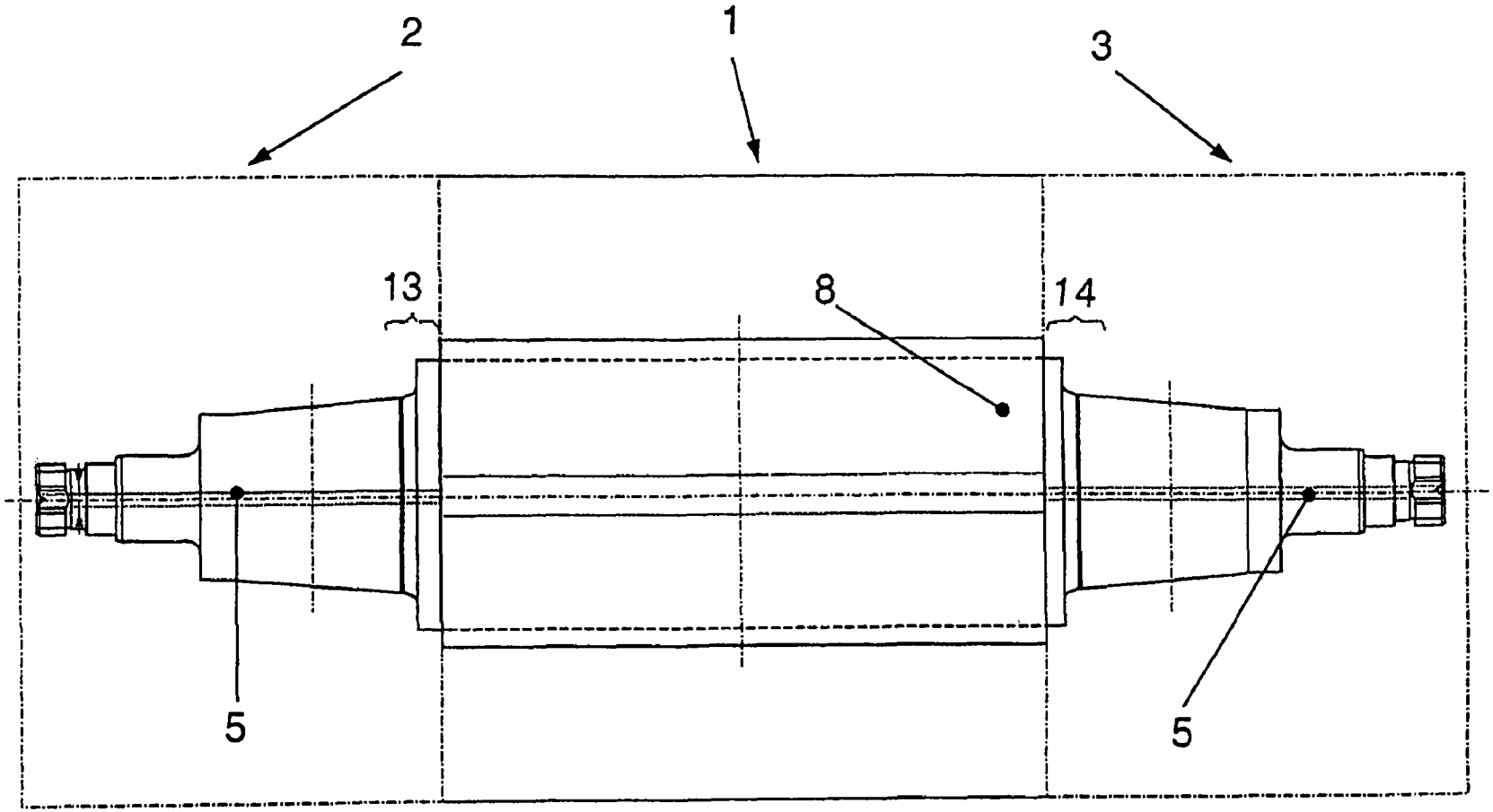
FIG. 2: The inventive roll in an alternative embodiment with three roll parts

FIG. 2 presents a different embodiment of the inventive roll. The joints are arranged close to the barrel ends, which are basically formed by the main part 1. The roll comprises two end parts 2 and 3, which are connected by the joints 6 with the main part 1. The end parts can be designed with center bores 5. The diameter of the center bores 5 can be defined based on the loads and the internal defects arising from casting or forging. Due to the smaller diameter of the end parts 2 and 3 compared to the main part 1 the diameter of the bores 5 is considerably smaller than the diameter of the bore 4. The joints are placed in the areas 13 and 14. As noted above, the bore diameter of the main part 1 may be formed in an embodiment thereof with a bore diameter of 0.5-1.5 and preferably 0.8-1 times bigger than the smallest outside diameter of the end part.

Figure 3:
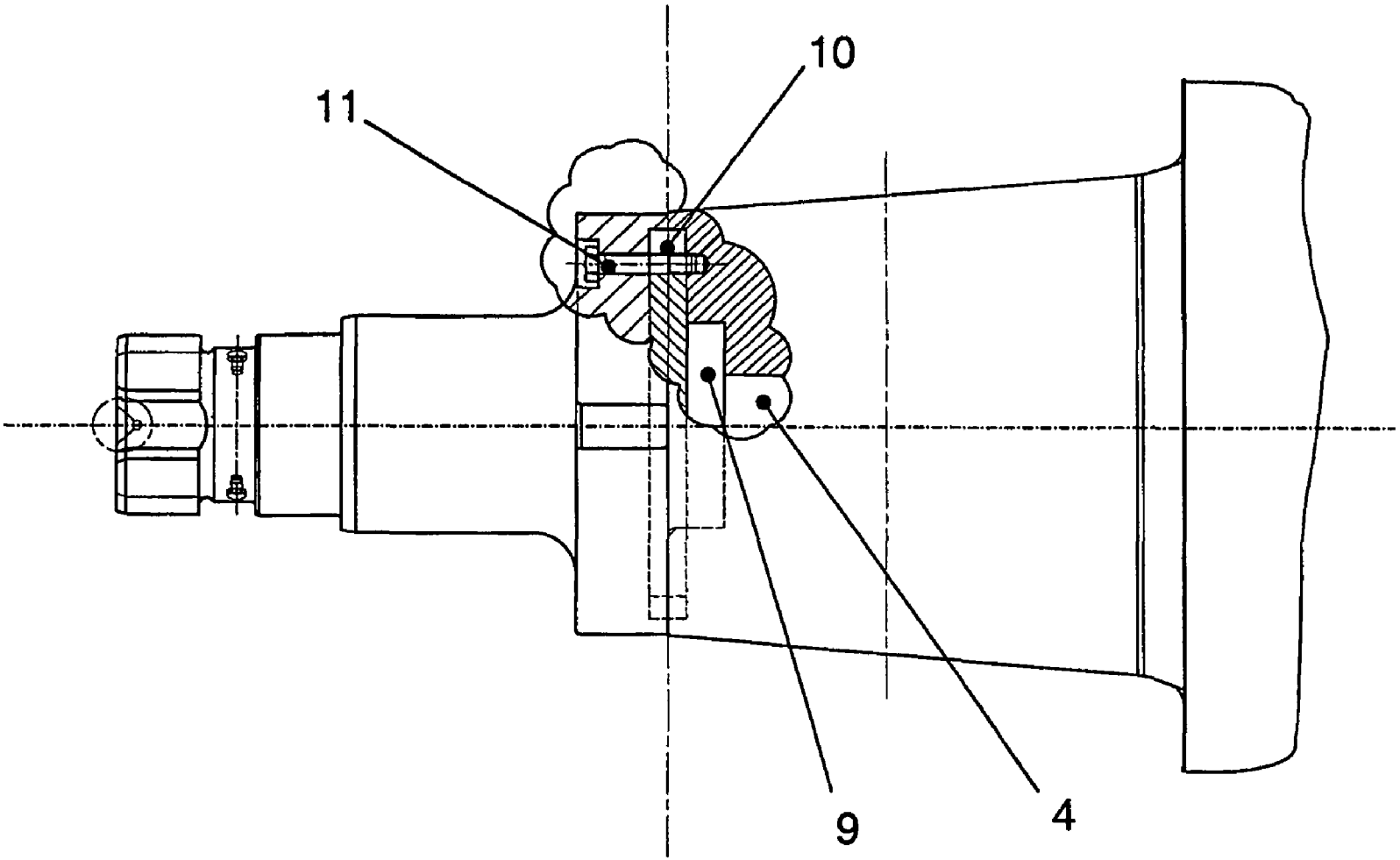
FIG. 3: Detail of the inventive roll with the joint

In FIG. 3 the joint 6 is depicted in more detail. The end part 2 is attached to the main part 1 by means of the joint 6 comprising a locating spigot 9 located in a recess of the main part 1. A key 10 is arranged to avoid relative movement of the parts. By means of a plurality of bolts 11 the end part 2 is bolted to the main part 1 whereby a form-fit joint is created assuring a very stiff roll.

Figure 4:
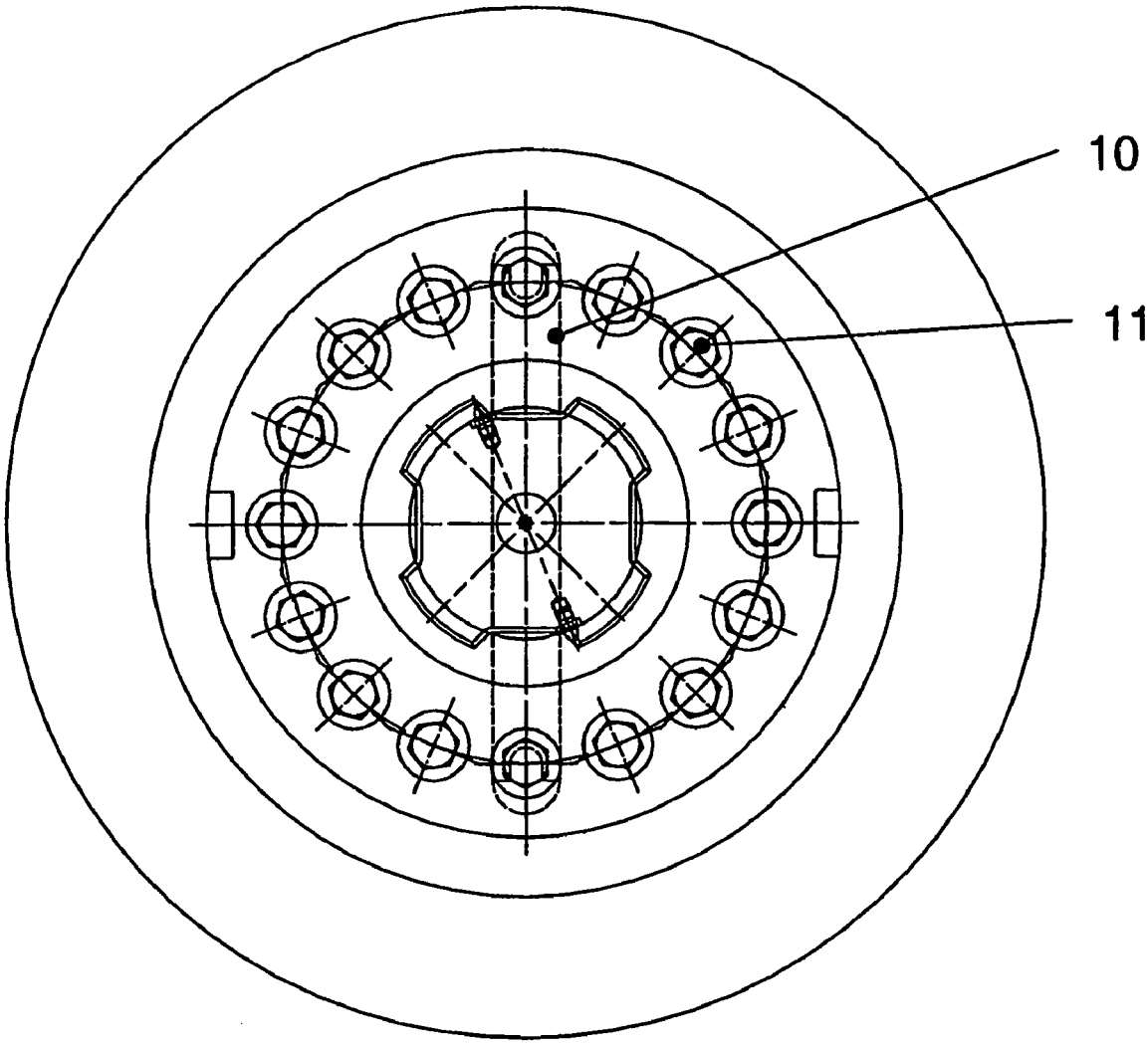
FIG. 4: Joint according to the invention in axial view

FIG. 4 is a view in axial direction. The position of the key 10 is indicated in the main part 1 and fixed together by the end part 2 and the bolts 11.

The position of the joints can be defined according to the application of the roll and the requirements can be met much better due to the increased possibilities based on the multiple piece roll. The concept can be applied to all kind of rolls however especially with large diameter backup rolls the most benefits can be achieved.

The invention claimed is:

1. A cast or forged multiple piece backup roll used for rolling of metals between at least one pair of rolls, the backup roll comprising:

a single piece main part with opposite axial ends and at least one end part axially joined to a respective end of the main part in order to form the backup roll, wherein a hollow axial center bore extends axially through the main part, the hollow axial center bore having a diameter based on the expected loads and the allowable stresses occurring during normal use of the backup roll and the size and the position of detected material defects; and the end part has no hollow axial center bore or has a hollow axial center bore with a diameter smaller than a diameter of the hollow axial center bore of the main part.

2. The multiple piece backup roll, as defined in claim 1, further comprising a form-fit joint between the axially joined main part and the end part, wherein the form-fit joint is arranged substantially at a right angle to the axis of the roll.

3. The multiple piece backup roll, as defined in claim 1, wherein at least one of the main and the end parts has a respective hollow axial center bore with a diameter varying in axial direction.

4. A combination of the multiple piece backup roll, as defined in claim 2, and at least one roll bearing, wherein the backup roll includes a roll neck, the roll neck including a part of the main part and the end part, the roll neck including a support area for the roll bearing, and the form-fit joint is arranged nearer to the end part than the support area.

5. The multiple piece backup roll, as defined in claim 2, wherein the main part of the backup roll comprises a roll barrel with opposite axial ends and the form-fit joint between the main and end part is arranged at the axial end of the roll barrel.

6. The multiple piece backup roll as claimed in claim 1, wherein the main part has opposite ends, and there are two of the end parts, and each of the end parts is axially joined to a respective one of the ends of the main part.

7. The multiple piece backup roll as claimed in claim 6, wherein each of the at least one end part has a hollow axial center bore.

8. The multiple piece backup roll as claimed in claim 7, wherein a diameter of the hollow axial center bore in the main part is 0.5-1.5 times bigger than a smallest outside diameter of the end part.

9. The multiple piece backup roll as claimed in claim 7, wherein the diameter of the hollow axial center bore of each roll part is defined individually in order to allow an optimized load situation for each roll part.

10. The multiple piece backup roll, as defined in claim 1, wherein at least one of the roll parts is made of at least one cast and forged material.

11. A cast or forged multiple piece backup roll used for rolling of metals between at least one pair of rolls, the backup roll comprising:

a main part with opposite axial ends and at least one end part axially joined to a respective end of the main part in order to form the backup roll, wherein a hollow axial center bore extends axially through the main part, the hollow axial center bore having a diameter based on the expected loads and the allowable stresses occurring during normal use of the backup roll and the size and the position of detected material defects; and the end part has no hollow axial center bore or has a hollow axial center bore with a diameter smaller than a diameter of the hollow axial center bore of the main part, the multiple piece backup roll further comprising a form-fit joint between the axially joined main part and the end part, wherein the form-fit joint is arranged substantially at a right angle to the axis of the roll, and wherein the form-fit joint comprises a locating spigot, a key and a number of bolts all extending from one of the main and end parts into the other for the creation of the form-fit joint.

12. A process for the manufacture of a backup roll used in metal rolling, wherein the backup roll comprises at least one main part and at least one end part;

the process comprising:

casting or forging for manufacturing at least one of the parts, detection of defects or flaws along the centerline of at least one of the parts arising from the manufacturing process, and forming an axial center bore in at least one of the parts, wherein the bore is formed to remove the centerline defects or flaws arising from the manufacturing process, and wherein the diameter of the axial center bore is defined based on expected loads and allowable stresses occurring during normal use of the backup roll and the size and the position of detected material defects; and axially joining the main part to each of the at least one end part.

13. A process as defined in claim 12, wherein the diameter of the axial center bore of the main part is formed 0.5-1.5 times bigger than the smallest outside diameter of the end part.

14. A process as defined in claim 12, further comprising forming the axial center bore in each of the parts wherein the diameter of the axial center bore of each roll part is defined individually in order to allow an optimized load situation for each roll part.

15. A process as defined in claim 12, wherein the diameter of the axial center bore of the main part is formed 0.8-1 times bigger than the smallest outside diameter of the end part.

16. A process according to claim 12, wherein the axial center bore of the end part has a diameter smaller than a diameter of the axial center bore of the main part.

17. A process according to claim 12, wherein the main part and the end part are joined by means of a form-fit joint, wherein the joint is arranged substantially at a right angle to the axis of the roll.

18. A process according to claim 12, wherein at least one of the at least one main part and the at least one end part has an axial center bore with a diameter varying in axial direction.

19. A process according to claim 17, wherein the backup roll includes a neck, the neck including a part of the main part and the end part, and wherein the form-fit joint is arranged nearer to the end part than a support area for roll bearings and within the neck of the backup roll.

20. A process according to claim 17, wherein the main part of the backup roll comprises a roll barrel with opposite axial ends and wherein the form-fit joint is arranged at an axial end of the roll barrel.

* * * * *